US007438096B2

(12) United States Patent
Holbert et al.

(10) Patent No.: US 7,438,096 B2
(45) Date of Patent: Oct. 21, 2008

(54) VENEER COMPOSER

(75) Inventors: John Holbert, Brinnon, WA (US); Paul Knapp, Corvallis, OR (US); Matt Bauer, Keizer, OR (US)

(73) Assignee: Corvallis Tool Company, Philomath, OR (US)

( * ) Notice: Subject to any disclaimer, the term of this patent is extended or adjusted under 35 U.S.C. 154(b) by 0 days.

(21) Appl. No.: 11/373,839

(22) Filed: Mar. 9, 2006

(65) Prior Publication Data

US 2007/0209734 A1 Sep. 13, 2007

(51) Int. Cl.
*B27C 1/00* (2006.01)

(52) U.S. Cl. ..... 144/162.1; 144/3.1

(58) Field of Classification Search ..... 144/1.1, 144/2.1, 3.1, 209.1, 162.1, 178
See application file for complete search history.

(56) References Cited

U.S. PATENT DOCUMENTS 3,445,313 A * 5/1969 Clausen et al. ..... 156/433
3,774,750 A * 11/1973 Streckert ..... 83/208
4,732,067 A * 3/1988 Yamada ..... 83/346
4,931,113 A * 6/1990 Feichtmeir et al. ..... 156/64
5,235,518 A 8/1993 Maekawa et al.
5,383,504 A * 1/1995 Cremona ..... 144/215
5,974,923 A 11/1999 Rigby, Jr. et al.

* cited by examiner

*Primary Examiner*—Shelley Self
(74) *Attorney, Agent, or Firm*—Schwabe, Williamson & Wyatt, P.C.

(57) ABSTRACT

A veneer composer is provided including a skew correcting station adapted to square at least one edge of a veneer piece to a reference side, a clipping station adapted to move in the same direction and at the same material being clipped, and a gap closing station adapted to close the gap between adjacent veneer pieces without causing excessive force between the adjacent edges.

21 Claims, 9 Drawing Sheets

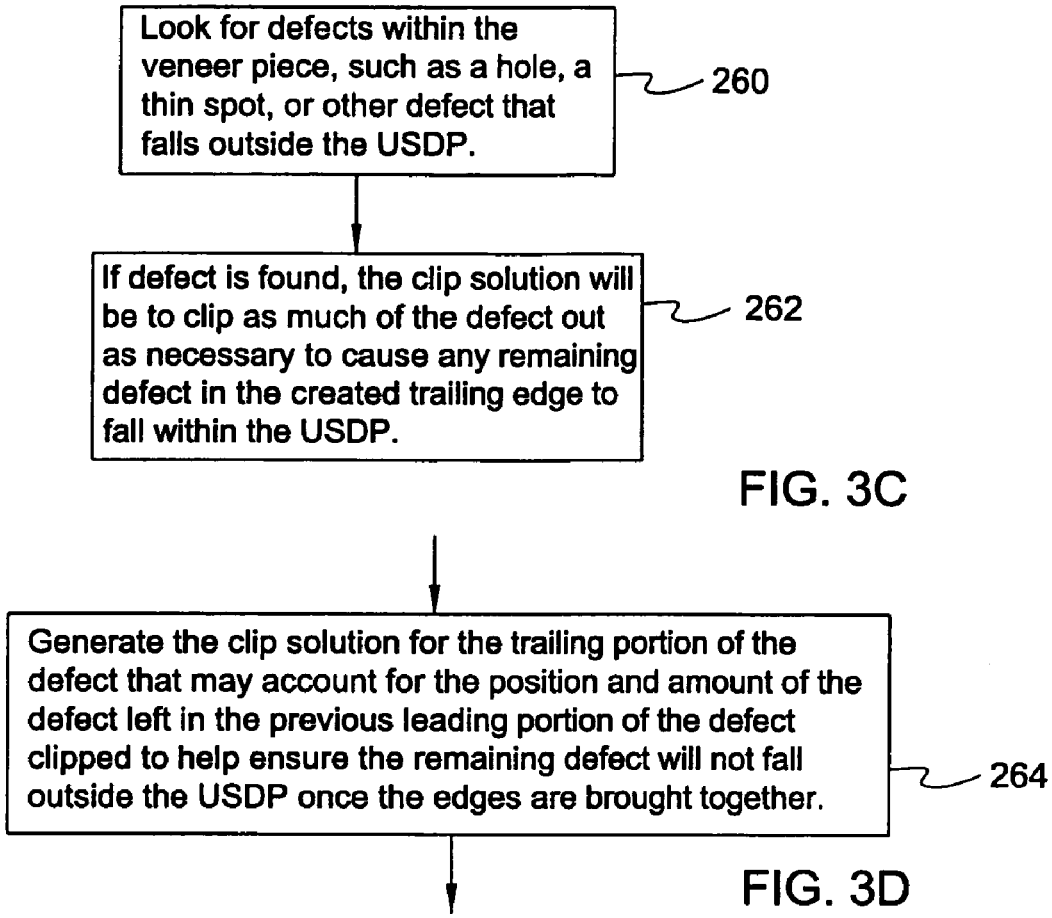
FIG. 3C
FIG. 3D
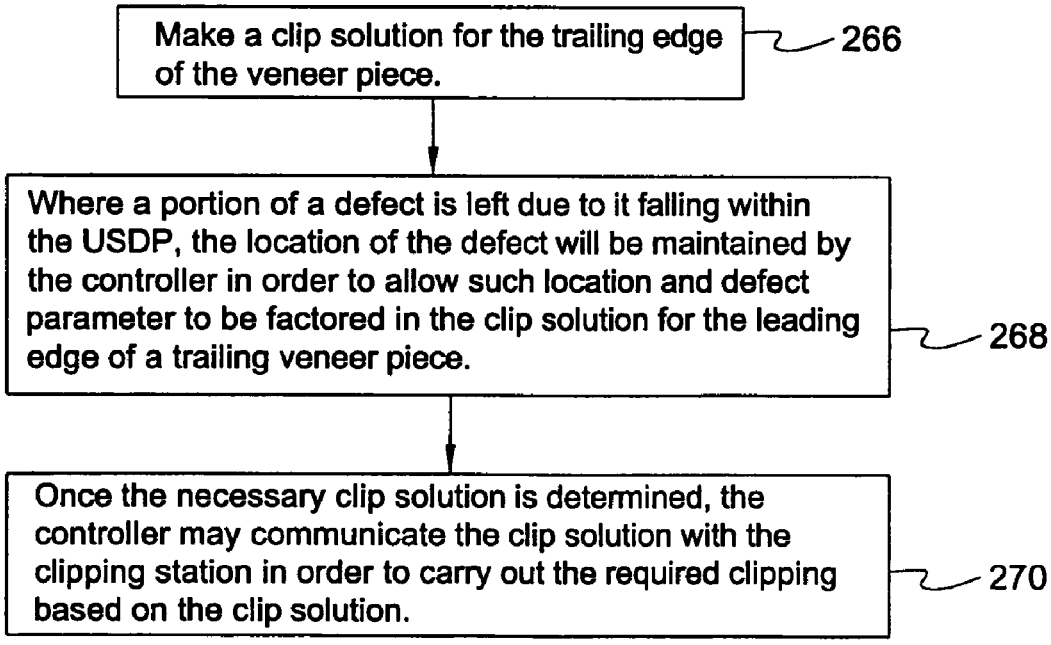
FIG. 3E

VENEER COMPOSER

FIELD OF THE INVENTION

Embodiments of the invention relate generally to the field of veneer composers, and more particularly to a veneer composer and veneer composer stations adapted to process veneer pieces in an efficient manner while reducing processing time and material waste.

BACKGROUND

Veneer composers are machines adapted to assemble random width pieces of veneer into a continuous ribbon of veneer. The continuous ribbon may be further cut into sheets of a desired length, joined, and layered as necessary to make engineered lumber such as Laminated Veneer Lumber (LVL) and plywood.

A typical composer may include a feed station where an operator selects and feeds veneer sheets to be processed by the composer. The veneer pieces may be of varying widths and have non-squared edges and/or defect regions that require trimming prior to the veneer pieces being formed into a continuous ribbon. Traveling on a conveyor through the composer, a clipping station clips the leading and trailing edges of each veneer piece to produce parallel and squared edges. Defects in the veneer pieces are also clipped to entirely remove the defect in a particular piece. The clipping of the leading and trailing edges, as well as removal of the entire defect, not only is a source of great waste, but it also wastes time and increases the number of operations required by the clipper.

Once the edges and defects are clipped, the individual pieces are crowded edge-to-edge against each other at a crowding station. The crowding station is generally a conveyor that is traveling at a rate significantly less than the material flow rate of the individual veneer pieces coming from the clipping station. This difference in speed causes the leading edge of a trailing piece to ram into or crowd with the trailing edge of a leading piece to ensure there are no gaps therebetween. Crowding is acceptable for some wood species, but not others. Woods like Eucalyptus are susceptible to bunching when run through a crowding station, which results in machine downtime. Also, crowding the edges of adjacent pieces may cause one edge to rise above and overlap the adjacent piece. Such overlapping causes manufacturing problems when the sized veneer sheets are layered, and can result in unacceptable weaknesses.

To hold the crowded pieces of veneer together, adhesive impregnated strings are typically bonded to one or both sides of the veneer pieces, thereby forming a continuous ribbon of veneer. This continuous ribbon is then passed through another clipping station where sheets of a desired length are clipped for further processing into engineered wood.

Improving on the composers described above is necessary in order to reduce the amount of waste that is generated. Further, improvements are needed to improve the continuity of the flow rate of material through the composer in order to increase the efficiency and effectiveness of the machine, particularly with materials that tend to require more delicate handling.

BRIEF DESCRIPTION OF THE DRAWINGS

Embodiments of the invention are illustrated by way of example and not by way of limitation in the figures of the accompanying drawings, in which like references indicate similar elements and in which:

FIGS. 3A through 3E illustrate a method of determining a Clip Solution in accordance with an embodiment of the present invention;

DETAILED DESCRIPTION

Figure 1A:
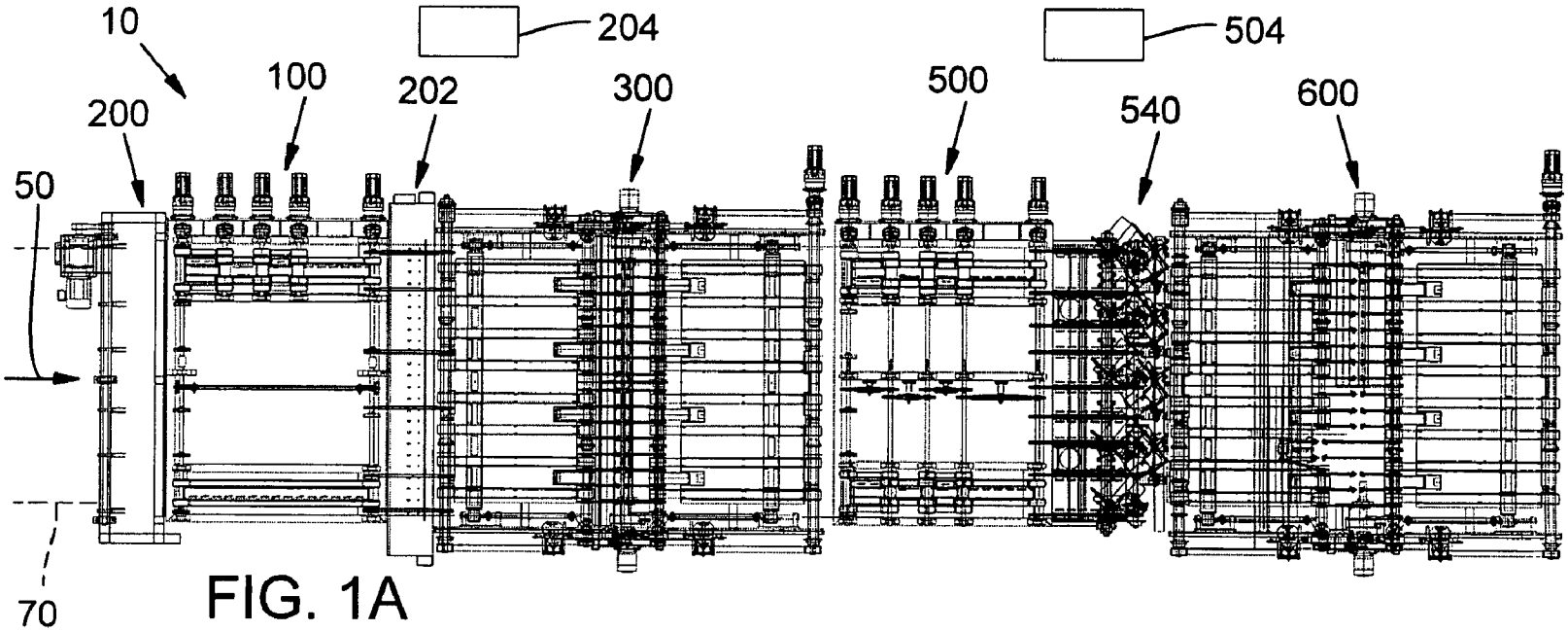
FIGS. 1A and 1B illustrate a top view and a side view respectively of a composer in accordance with an embodiment of the present invention.

Various aspects of the illustrative embodiments will be described using terms commonly employed by those skilled in the art to convey the substance of their work to others skilled in the art. However, it will be apparent to those skilled in the art that alternate embodiments may be practiced with only some of the described aspects. For purposes of explanation, specific materials and configurations are set forth in order to provide a thorough understanding of the illustrative embodiments. However, it will be apparent to one skilled in the art that alternate embodiments may be practiced without the specific details. In other instances, well-known features are omitted or simplified in order not to obscure the illustrative embodiments.

Further, various operations will be described as multiple discrete operations, in turn, in a manner that is most helpful in understanding the present invention; however, the order of description should not be construed as to imply that these operations are necessarily order dependent. In particular, these operations need not be performed in the order of presentation.

In the following description and claims:

The phrase "in one embodiment" may be used repeatedly. The phrase generally does not refer to the same embodiment; however, it may. The terms "comprising," "having," and "including" are synonymous, unless the context dictates otherwise.

The phrase "A/B" means "A or B". The phrase "A and/or B" means "(A), (B), or (A and B)." The phrase "at least one of A, B and C" means "(A), (B), (C), (A and B), (A and C), (B and C) or (A, B and C)." The phrase "(A) B" means "(B) or (A B)," that is, A is optional.

The terms "coupled" and "connected," along with their derivatives, may be used. It should be understood that these terms are not intended as synonyms for each other. Rather, in particular embodiments, "connected" may be used to indicate that two or more elements are in direct physical or electrical contact with each other. "Coupled" may mean that two or more elements are in direct physical or electrical contact.

However, "coupled" may also mean that two or more elements are not in direct contact with each other, but yet still cooperate or interact with each other.

Embodiments of the present invention may include a veneer composer that is adapted to skew correct pieces of veneer to try and avoid the need to clip each leading and trailing edge, which in turn reduces waste. Embodiments may also be adapted to controllably clip only a portion of a defect that is necessary to reduce the defect size such that it fits within a user specified defect parameter ("USDP"). Further, embodiments of the present invention may be adapted to make the defect clipping decision based on a lower number of data points defining a defect, such as length and width, which not only may increase speed and efficiency, it may also reduce the costs associated with controllers and other components needed to control the composer operations.

Embodiments of the present invention may also include a clipping station having a clipper assembly adapted to travel in the material flow direction (MFD), and make the necessary clip at the material flow rate (MFR). Clipping at the MFR helps maintain the continuity of flow of veneer pieces through the composer line, thereby improving efficiency of the process.

Further embodiments of the present invention may include a gap closing station adapted to controllably close the gap between a trailing edge of a leading veneer piece and the leading edge of a trailing veneer piece coming from the clipping station. Such a gap closing station can bring the edges together for ribbon formation without excessive impact force that may cause bunching, overlapping or other undesirable effects, thereby improving composer efficiency and reducing downtime.

Figure 1B:
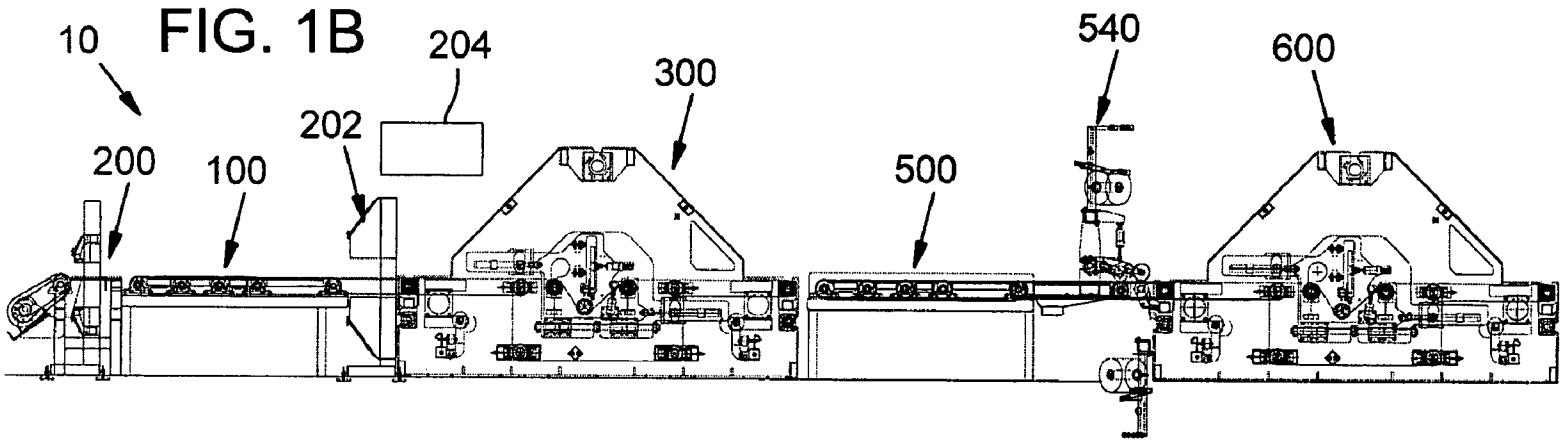

FIGS. 1A and 1B illustrate a top view and a side view respectively of a veneer composer in accordance with embodiments of the present invention. Composer 10 may include some of the components previously described in the background, and may further include a skew correct station 100. Skew correct station 100 may be adapted to move one end of a veneer piece forward or backward relative to the other end of the veneer piece and relative to MFD 50. Such controllable movement may allow the positioning of at least one edge of the veneer piece, either leading or trailing, such that it is substantially perpendicular to a reference side 70. Skew correct station 100 may make the alignment adjustment of the veneer piece based on data collected by a skew correct scanner 200 positioned upstream of the skew correct station 100.

Skew correct scanner 200 may be adapted to collect data pertaining to the edges of the veneer piece (De-skew Data). The De-skew Data may be sent to a PLC or other computer and/or controller 204. Controller 204 may be adapted to process the De-skew Data and look for, for example, the edge of the veneer piece that comes the closest to being able to make a 90 degree corner with respect to reference side 70, once de-skewed. The controller 204 then causes the skew correct station 100 to adjust the veneer piece accordingly.

Once the veneer piece is adjusted such that at least one edge is generally perpendicular to reference side 70, a second, or defect scanner 202 may be positioned downstream from the skew correct station 100 and be adapted to collect data on the edges and defects that may be present in the veneer piece (Clip Data). The Clip Data collected by the defect scanner 202 may be sent to controller 204. Controller 204 may process the Clip Data and determine the best clipping solution for removing the defect (Clip Solution). In other embodiments, the Clip Data may be sent to a separate controller than that of the De-skew Data.

In one embodiment of the present invention, the skew correct scanner 200 and the defect scanner 202 may be both positioned upstream of the skew correct station 100 and adapted to simultaneously collect the De-skew Data and the Clip Data that is necessary data for both skew correction defect identification. Further, in another embodiment, the skew correct scanner 200 and defect scanner 202 may be an integrated scanning system adapted to collect both De-skew Data and Clip Data, and communicate such information to the same or separate controllers.

Composer 10 may also include a first clipping station 300 having a clipper assembly adapted to clip the veneer pieces per the Clip Solution determined by controller 204. Clipping station 300 may move in MFD 50 and clip the veneer pieces while traveling at MFR such that there is little or no relative linear movement with respect to MFD between the clipper assembly and the veneer piece during the actual clip. Some of the conveyors upon which the veneer pieces may be transported on through the clipping station 300, may also be adapted to move both linearly and rotationally such that while the conveyor is moving linearly with the clipper head assembly its rotational speed is reduced or stopped in order to maintain the MFR observed by the veneer piece being clipped.

Composer 10 may also include a gap closing station 500 adapted to close the gap between the veneer pieces coming from the clipping station 300. Gap closing station 500 may close the gap between the trailing edge of a leading veneer piece and the leading edge of a trailing veneer piece. The gap closing station 500 may include multiple pairs of conveyors adapted to increase or decrease the speed of a given piece of veneer relative to the MFR and relative to an adjacent veneer piece in order to bring the edges of two pieces of veneer together without an excessive force or impact between the edges as occurs in crowding stations.

In one embodiment of the present invention, the composer 10 may also include a stringing station 540 adapted to secure the pieces of veneer together in a continuous ribbon. A second clipper station 600 may also be included and adapted to cut the continuous ribbon of veneer at desired points to result in veneer sheets of a desired width. Second clipper station 600 may be similar to the first clipper station 300 such that it may include a moving clipper assembly and conveyor system. In one embodiment of the present invention, one or both of the first clipper station 300 or the second clipper station 600 may be a conventional clipping station.

Figure 2A:
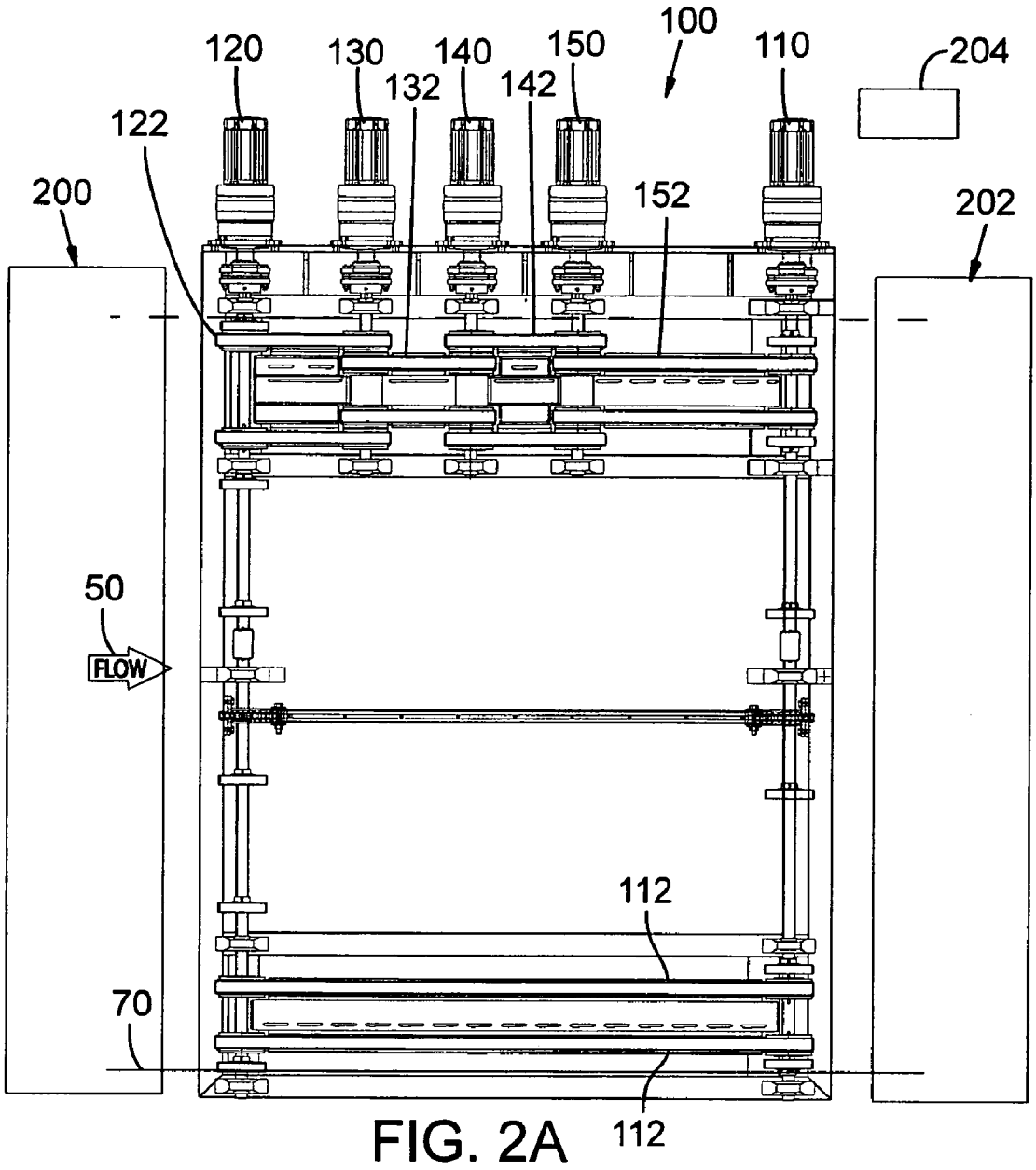
FIGS. 2A and 2B illustrate a top view and a side view respectively of a skew correcting station in accordance with an embodiment of the present invention.
Figure 2B:
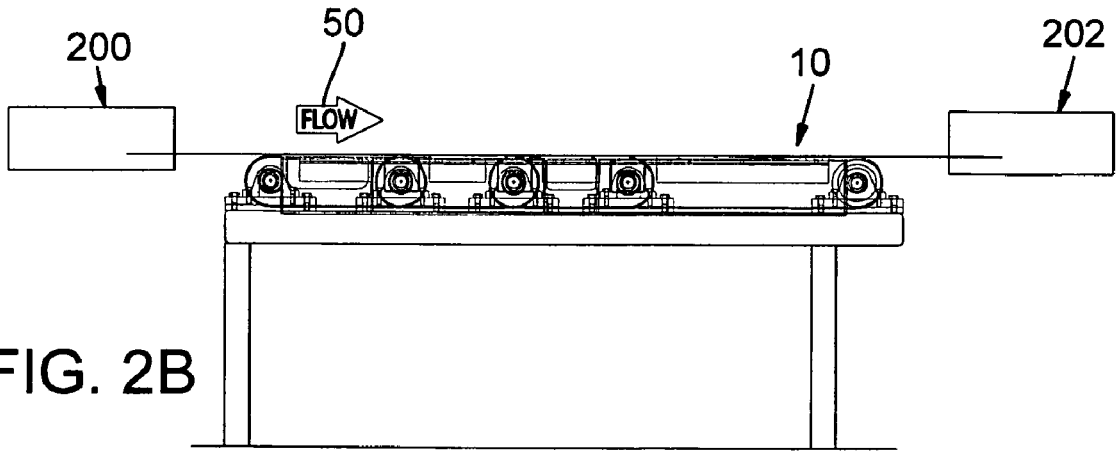

FIGS. 2A and 2B illustrate a top and side view of a skew correct station 100 in accordance with an embodiment of the present invention. In one embodiment, as a veneer piece travels past scanner 200, scanner 200 collects the De-skew Data pertaining to the shape and orientation of the veneer piece as it is moving in MFD 50. In one embodiment, controller 204 may process the De-skew Data and determine which of the leading and trailing edge of a veneer piece has the best potential to be orientated closest to perpendicular relative to reference side 70.

In another embodiment, the controller 204 may determine which corner of a veneer piece is the closest to 90° and correct the positioning of the veneer piece such that the corner is at a right angle with the reference side 70. In yet another embodiment, the controller 204 may determine which edge of a veneer piece, top or bottom, may be oriented such that it is substantially parallel with the reference side 70. Regardless of the point of reference used, the controller 204 will attempt to cause the skew correct station to square at least one edge of the veneer piece with either the reference side 70 or the side opposite the reference side.

Skew correct station 100 may include one or more first conveyors 112 positioned towards the reference side 70 and adapted to convey a corresponding one end of a veneer piece at the desired MFR. First conveyors 112 may be driven by driver 110, which may be for example a servo motor, or other speed control device.

Towards the opposite side of the skew correct station 100 may be positioned a plurality of de-skew conveyors (DSC) adapted to convey the opposite end of the veneer piece in MFD 50. In one embodiment, the DSCs may be staggered such that they overlap with adjacent DSCs to facilitate transfer of the veneer piece from one DSC to another. The DSCs may also be independently controlled such that they may cause the end of the veneer piece being conveyed by a particular DSC to advance the end forward or backward with respect to MFD 50 by increasing or decreasing the rotational speed of the particular DSC.

In one embodiment of the present invention, four sets of DSCs 122, 132, 142, and 152 may be positioned towards the opposite side of the skew correct station 100 from the reference side 70. First DSC 122 (e.g., rotational speed) may be independently controlled by driver 120. Second DSC 132 may be independently controlled by driver 130. Third DSC 142 may be independently controlled by driver 140. And, fourth DSC 152 may be independently controlled by driver 150. Drivers 120, 130, 140, and 150 may be independently controlled drivers, such as servo motors that may be coupled to and controlled by controller 204.

In one embodiment of the present invention, DSCs 122 and 132 may share a common rotational axis at one end such that the DSCs 122 and 132 overlap to facilitate uninterrupted transfer of the veneer pieces in the MFD. Similarly DSCs 132 and 142 may overlap and share a common rotational axis, as may DSCs 142 and 152. In one embodiment, DSC 152 may share a common rotational axis with first conveyor 112 in order to facilitate transfer of the de-skewed veneer piece from the skew correct station 100 to a further conveyor or other station.

In operation, once the veneer piece is scanned at first scanner 200, controller 204 may determine the appropriate edge to de-skew such that it will be generally perpendicular or squared to the reference side 70. Based on the width of the veneer piece, controller 204 may cause the veneer piece to advance to a particular DSC that is of a length sufficient to accommodate such a veneer piece width. Controller 204 can then cause the driver of the DSC to speed up or slow down with respect to the MFR in order to cause the selected edge to orient generally perpendicular to reference side 70. Likewise, where a piece is wider than any one DSC, a combination of one or more DSCs may be used to accommodate the veneer piece width and orient it by having the DSC drivers modify the speed of the end of the veneer piece, which in turn may cause the selected edge of the veneer piece to orient in a generally perpendicular manner, or make the best 90° corner with the reference side 70.

In various embodiments of the present invention, any number of DSCs may be used and independently controlled to alter the rate from MFR (i.e., a rate that is faster, slower, or the same as the rotational speed of the first/reference conveyors 112). Likewise, in various embodiments, the DSCs may be positioned towards the reference side 70 and the first conveyors 112 may be positioned towards the opposite side. Further, the DSCs do not need to share a common rotational axis but may be positioned such that they have ends that are in proximity to one another, or only slightly overlap in order to ensure transition of the veneer piece from one DSC to the next DSC. While the DSCs are illustrated to come in pairs, in other embodiments of the invention, single DSCs or multiple redundant DSCs may be used. Finally, while the skew correct station 100 has been described as being used to de-skew veneer sheets, in other embodiments the skew correct station may be used to de-skew other lumber products in other processes.

Figure 2C:
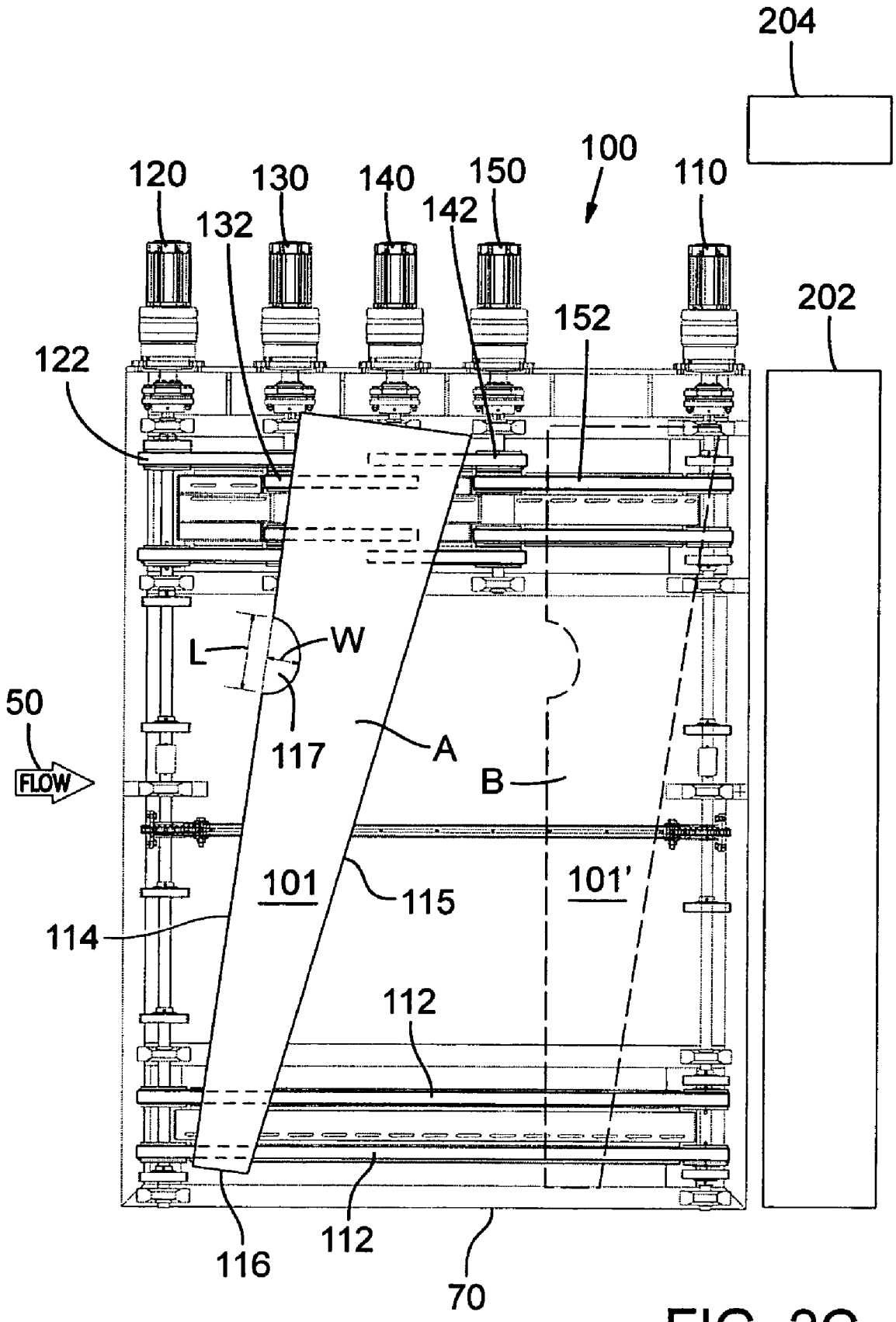
FIG. 2C illustrates a top view of a skew correcting station in accordance with an embodiment of the present invention.

FIG. 2C illustrates an example of a veneer piece passing through the skew correct station 100 of FIGS. 2A and 2B in accordance with an embodiment of the present invention. Veneer piece 101 enters the skew correct station 100 in a skewed fashion, as generally referred to as position A, and in an MFD 50. While veneer piece 101 has a defect 117, controller 204 may have determined that edge 114 is the best edge to be oriented such that it may be generally perpendicular to reference side 70. Opposite edge 115 may be angled in such a manner that it may not be acceptably skewable to a squared or perpendicular position relative to reference side 112.

In order to de-skew the veneer piece, drivers 130 and 140 may be controlled such that DSCs 132 and 142 are slowed with respect to MFR (as may be determined by the rate of reference conveyors 112) a determined amount such that the continued travel of end 116 of veneer piece 101 at MFR will cause veneer piece 101 to be de-skewed as shown by veneer piece 101', and as generally referred to as position B. In one embodiment, as the veneer piece is being de-skewed, drivers 140 and 150 may gradually increase their speed to match MFR and that of reference conveyors 112 at the point where the veneer piece is just achieving its de-skewed orientation. Once de-skewed, veneer piece 101' is ready for further scanning and/or clipping as necessary.

As the de-skewed veneer piece 101' leaves the skew correct station 100, it may be scanned by a defect scanner 202. In one embodiment, defect scanner 202 may be adapted to detect a number of user specified defects, including, but not limited to, a non-straight leading or trailing edge, a hole, a broken edge, a thin area, or other conditions deemed to be unacceptable by the user. The defect scanner 202 may include a variety of scanning techniques including, but not limited to, beam breaker photocell arrays, laser, light curtains, ultrasound, and the like.

It is also possible for certain defects to be acceptable to the user depending on the use of veneer piece, previously referred to as USDP. For example, in LVL lumber production, a defect of a certain amount may be allowed without sacrificing the overall integrity of the piece by virtue of the layering completed veneer sheets. Accordingly, only the amount of a defect, or non-perpendicular edge need be clipped to bring the veneer piece within USDP.

While the defect scanner may be adapted to collect a number of data points to fully characterize a defect or an edge, in one embodiment of the present invention, the defect scanner 202 need only collect four Clip Data points on the defect in order to sufficiently characterize and allow the controller to determine a Clip Solution. In one embodiment, the defect scanner 202 may define a defect 117 by its overall length L and width W.

For example, in one embodiment, a photocell array may be used such that the photocells capture data characterizing the approximate overall length L of defect 117. An encoder or other counting device may be used to capture data characterizing the approximate overall width W of defect 117, based on a certain number of counts. Once the data characterizing L and W is collected on a defect 117, such Clip Data may be conveyed to controller 204 (or a separate controller if so used) to determine the clip solution.

Where only four data points are collected to define the length and width of the defect, it has been found that a lesser amount of computing power may be required to generate the appropriate Clip Solution due to the simplicity of the calculations required to determine the solution for eliminating the defect, which in turn increases speed and efficiency and reduces the power of consumption. Further such minimal data collection and usage may enable the use of less elaborate and oftentimes simple or off-the-shelf-type controllers such as PLCs and the like. Based on the collected data, the controller 204 may determine a Clip Solution which may control when and where to clip the piece of veneer as it is traveling through the clipping station (discussed later).

Figure 3A:
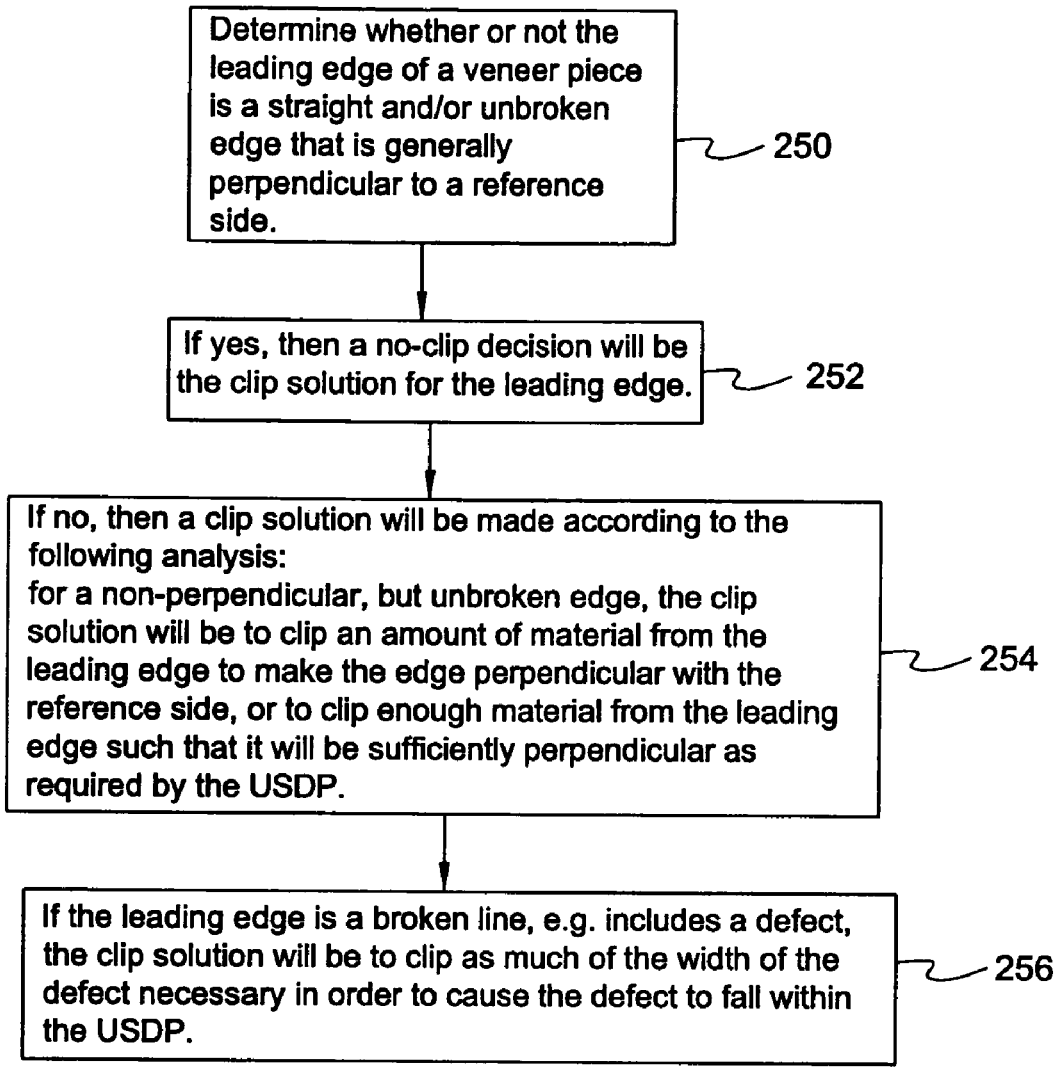
Figure 3B:
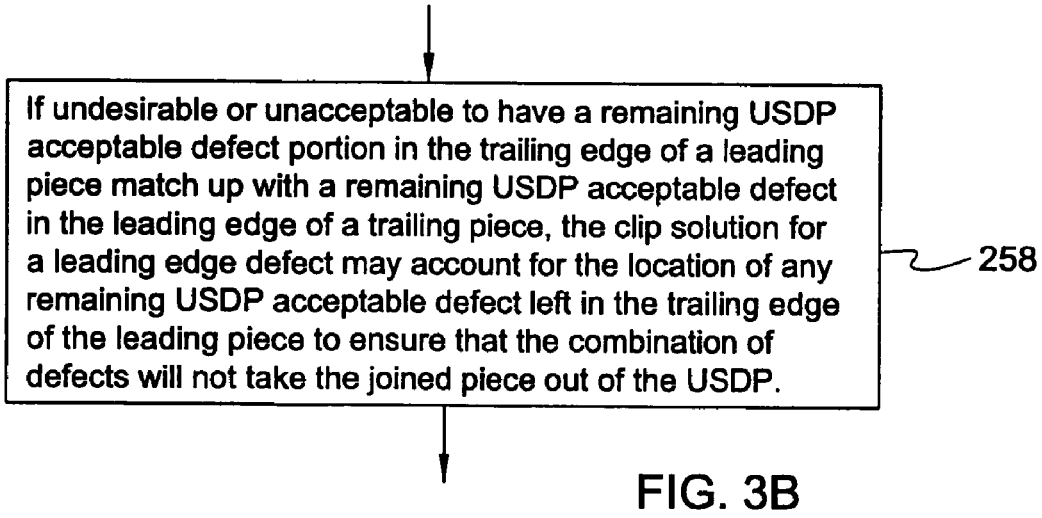

FIGS. 3A and 3B illustrate methods by which controller 204 may determine a Clip Solution that may reduce the amount of potential waste of the veneer piece being clipped, and which also may help maintain efficiency of the overall process flow. In one embodiment, the following analysis may be used:

Determine whether or not the leading edge of a veneer piece is a straight and/or unbroken edge that it is generally perpendicular to the reference side, 250. If it is, then a no-clip decision will be the Clip Solution for the leading edge, 252. If it is not, then a Clip Solution may be made according to the following analysis:

For a non-perpendicular, but unbroken edge, the Clip Solution may be to clip an amount of material from the leading edge to make the entire edge perpendicular with the reference side, or to clip enough material from the leading edge such that it will be sufficiently perpendicular as required by the USDP, 254.

If the leading edge is a broken line, e.g. includes a defect, the Clip Solution will be to clip as much of the width of the defect necessary in order to cause the defect to fall within the USDP, 256. In one embodiment, such as that illustrated in FIG. 3B, where it may be undesirable or unacceptable to have a remaining USDP acceptable defect portion in the trailing edge of a leading veneer piece matching up with a remaining USDP acceptable defect in the leading edge of a trailing veneer piece, the Clip Solution for a leading edge defect may account for the location of any remaining USDP acceptable defect left in the trailing edge of the leading piece to ensure that the combination of defects will not take the joined piece out of USDP, 258.

Referring to FIG. 3C, once the Clip Solution for the leading edge is made, the Controller may determine a Clip Solution for any defects within the veneer piece, such as a hole, thin spot or other defect that falls outside the USDP, 260. If such a defect is present, the Clip Solution will be to clip as much of the defect out as necessary to cause any remaining defect in the created trailing edge to fall within USDP, 262. In one embodiment, such as that illustrated in FIG. 3D, the controller 204 will generate the Clip Solution for the trailing portion of the defect that may account for the position and amount of the defect left in the previous leading portion of the defect clipped again to help ensure the remaining defect will not fall outside USDP once the edges are brought together, 264.

FIG. 3E illustrates a method of one embodiment according to the invention wherein the Controller may make a Clip Solution for a trailing edge of a veneer piece, 266. The Clip Solution for the trailing edge may be made in much the same way as the determination made for the Clip Solution of the leading edge of the veneer piece.

In one embodiment, where a portion of a defect is left due to it falling within USDP, the location and size of the defect may be maintained by the controller 204 in order to allow such location and defect parameter to be factored in the Clip Solution for the leading edge of veneer piece following the trailing edge, 268. Once the necessary Clip Solution is determined, the controller 204 may communicate the Clip Solution with clipping station 300 in order to carry out the required clipping based on the Clip Solution, 270.

Figure 4A:
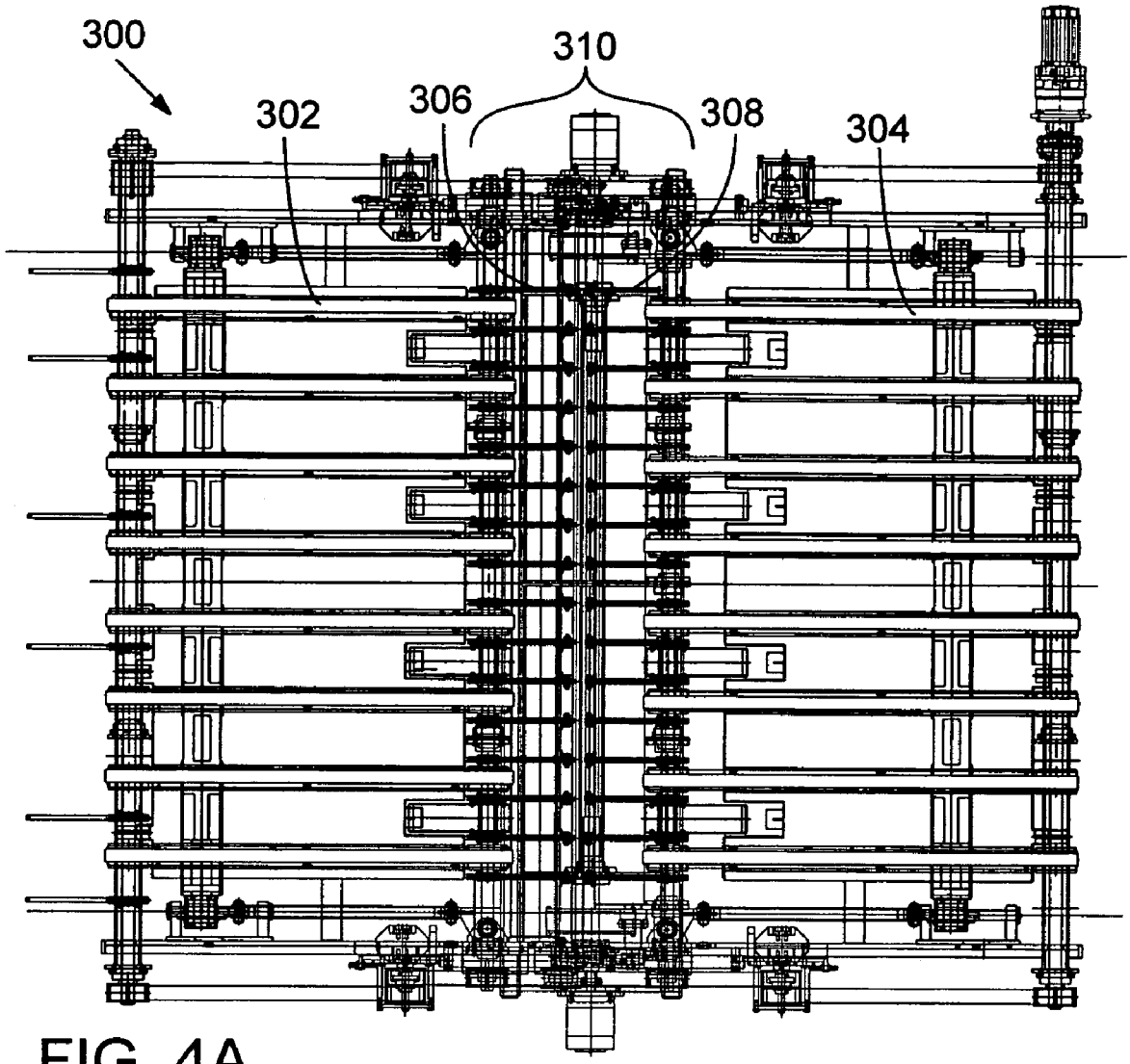
FIGS. 4A and 4B illustrate a top view and a side view respectively of a clipping station in accordance with an embodiment of the present invention.
Figure 4B:
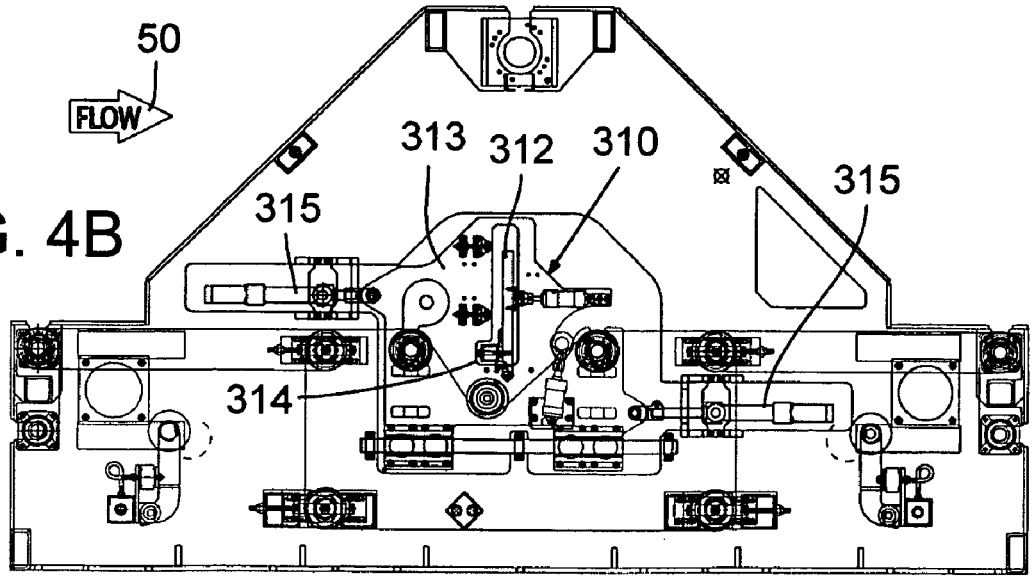

FIGS. 4A and 4B illustrate top and side views respectively of the clipping station 300 in accordance with the embodiment of the present invention. Clipping station 300 may include one or more cooperating in-feed conveyors 302 and out-feed conveyors 304 adapted to controllably convey veneer pieces moving through clipping station 300 in MFD 50. In one embodiment, in-feed conveyors 302 and out-feed conveyors 304 are adapted to convey veneer pieces in the MFD at MFR.

In one embodiment in accordance with the present invention, one or more additional conveyors, referred to herein as in-feed tipple conveyors 306 and out-feed tipple conveyors 308, may be furthered position in cooperation with the in-feed and out-feed conveyors 302 and 304 to cooperatively transport the veneer piece during the actual clipping operation.

A clipper assembly 310 may be moveably disposed towards the middle region of the clipping station and be adapted to clip the veneer sheet in the desired location as determined by controller 204. Clipper assembly 310 may include a carriage 313 that is adapted to move with and against MFD 50. In one embodiment, actuators 315 may be coupled to carriage 313 and adapted to cause carriage 313 to move either with or against MFD 50. Carriage 313 may be further adapted to carry a blade assembly 312 that may be adapted to work in cooperation with an anvil 314, also adapted to move with the carriage 313, to complete the clipping of a veneer piece based on the Clip Solution.

FIGS. 5A-5E illustrate enlarged cross sectional views of the blade assembly 312 that may be carried by carriage 313 of clipper assembly 310 in accordance with embodiments of the present invention. FIGS. 5A-5E also illustrate the blade assembly 312 in various stages of a clipping operation. In one embodiment of the present invention, blade assembly 312 may include a blade 320 adapted to move vertically with respect to anvil 314. Blade 320 may include a cutting edge 321 adapted to cooperate with anvil 314 and shear a veneer piece 318 in the proximity of the interface between the cutting edge 321 and the anvil 314.

Blade assembly 312 may also include a pinch plate 322 that may also be adapted to move vertically with respect to the veneer piece 318 during a clip operation. Pinch plate 322 may be configured to contact the opposite surface of veneer piece 318 as that which is being contacted by anvil 314 to effectively pinch the veneer piece 318 therebetween (See, e.g., FIG. 5B). In one embodiment, the pinching action may only be enough to provide upper and lower support for the veneer piece 318 during the clip operation, but not so much that it unduly dents or otherwise damages the veneer piece.

In one embodiment, blade 320 may be positioned proximal to pinch plate 322, and be in sliding engagement therewith. Blade 320 and pinch plate 322 may be coupled together in a fashion that such that when pinch plate 322 contacts the surface of veneer piece 318 it will stop moving in the vertical direction, while the blade 320 may continue to travel vertically with respect to veneer piece 318, thereby clipping veneer piece 318 in cooperation with the edge of anvil 314 (See, e.g., FIG. 5C). In one embodiment of the present invention, a biasing member 323, such as a gas shock absorber, elastomer, spring and the like, may be coupled to the pinch plate 322 and the blade assembly 312 such that as the pinch plate 322 contacts the surface of the veneer piece 318, the biasing member 323 may compress as blade 320 continues to travel in the vertical direction past the veneer piece 318.

In one embodiment of the present invention, vertical movement of blade assembly 312 may be driven by an eccentric drive mechanism, which may be adapted to remain generally stationary while the blade assembly moves with or against MDD. However in other embodiments, a variety of other drive mechanisms may be used to vertically move blade assembly 312, including, but not limited to, hydraulic and pneumatic actuators.

Figures 5A, 5B, 5C, 5D, 5E:
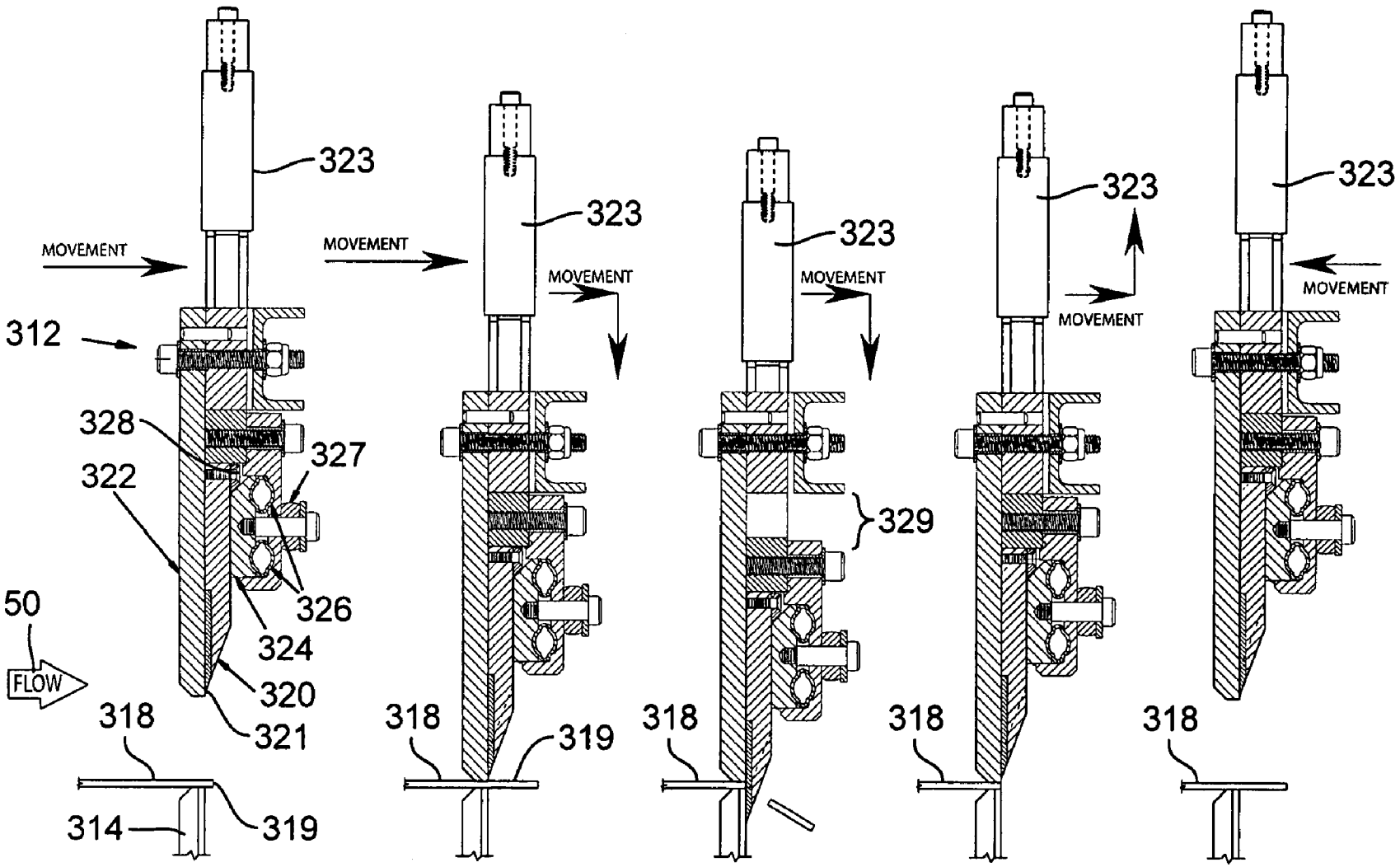
FIGS. 5A through 5E illustrate cross sectional views of a blade assembly in accordance with an embodiment of the present invention.

FIGS. 5A-5E illustrate the movement of a blade assembly during a clip operation in accordance with an embodiment of the present invention. As illustrated in FIG. 5A, a veneer piece 318 may be fed into the clipper assembly and positioned over anvil 314, such that the clip portion 319 based on the Clip Solution is extended over the anvil edge. Somewhat simultaneously, the clipper assembly 310 may begin to shift or move in MFD in order to decrease the relative horizontal movement between the blade assembly 312 and the veneer piece 318. In one embodiment, blade assembly 312 will be traveling at MFR by the time the clip operation is to take place. Blade assembly 312 may also begin moving vertically towards the veneer piece 318.

FIG. 5B illustrates blade assembly 312 just prior to the clip operation, where pinch plate 322 has engaged the opposite side of veneer piece 318 from that of anvil 314 but blade 320 has not yet initiated the clip of clip portion 319. at such a point, blade assembly 312 may be shifting in MFD at approximately MFR.

FIG. 5C illustrates the blade 320 continuing to move vertically with respect to veneer piece 318 and completing the clip of clip portion 319. In the illustrated embodiment, pinch plate 322 may cause biasing member 323 to compress thus allowing blade 320 to continue to travel vertically a distance 329. FIG. 5D illustrates the blade 320 retracting from its downward most position once the clip of clip portion 319 is completed. Finally, FIG. 5E illustrates the blade assembly 312 moving upward, thus relieving any pressure induced between the pinch plate 322 and anvil 314. Also, blade assembly 312 may shift in a direction opposite of MFD in order to return to a home position for the next clip operation.

As further illustrated in FIG. 5A, in one embodiment in the present invention the blade assembly 312 may include a blade retention mechanism, adapted to allow slideable engagements between the blade 320 and pinch plate 322 without lateral movement during the clip operation, and also allow for quick and easy replacement of blade 320. In one embodiment, a clamp or piston 324 may be adapted to move against blade 320 in order to retain blade 320 in the clipping position proximal to the pinch plate 322. One or more pressurizable passages, for example, pneumatic passages 326 may be operationally positioned with respect to the clamp 324 such that inflation and/or pressurization of the pneumatic passages 326 may force clamp 324 against blade 320 to hold blade 320 in operational engagement with pinch plate 322.

A clamp biasing member 327 may be coupled to the clamp 324 in order to induce a bias force adapted to generally urge the clamp 324 away from blade 320. Thus, when the pneumatic passages 326 are deflated or depressurized, the clamp 324 may be urged away from blade 320. In such position, blade 320 may than be readily removed from the side of carriage 313 (shown in FIG. 4B) for replacement, sharpening or other activity. In one embodiment, the biasing force generated by the clamp biasing member 327 may be adapted to urge the blade 320 into operational engagement with pinch plate 322. In such an embodiment, pneumatic passages 326, when inflated, may overcome the biasing force and release the pressure applied to clamp 324.

In one embodiment, a keeper 328 or other formation may be coupled to blade 320 and disposed proximal to clamp 324. Keeper 328 may help prevent blade 320, while in the operational configuration, from undesirably separating from the blade assembly 312 when the blade assembly 312 moves upward after a clip operation is completed.

Referring back to FIGS. 4A-4B, in order for the clipper assembly 310 to complete a Clip Solution on a veneer piece "on the fly" (i.e., limit relative horizontal movement between the blade assembly and the veneer piece), in one embodiment in-feed and out-feed tipple conveyors 306 and 308 may be adapted to not only move rotationally, but also be adapted to shift linearly. The ability for such dual movement may allow the veneer piece to continue to travel at MFR and still enable the clipping operation on the fly. The linear shiftability of the in-feed and out-feed tipple conveyors 306 and 308 may be particularly useful where a pinch plate is used to pinch the veneer between the anvil prior to the clip, as the belt cannot continue to rotationally move.

Accordingly, in one embodiment, the sum of the tipple conveyor shift speed (i.e., linear movement) and the rotational speed of the tipple conveyors should be approximately equal to the desired MFR. This not only creates a situation where there is generally continuous and uninterrupted flow of veneer pieces through the clipping station, but also improves the quality of the clip for materials that may be particularly difficult to shear.

For example, when a veneer piece is being conveyed into the area of the clipper assembly, in order to have the sum of the tipple conveyor rotational speed and shift speed maintained at MFR, the in-feed and out-feed tipple conveyors 306 and 308 need to be traveling rotationally slower than MFR to compensate for the horizontal shift speed of the clipping assembly in the MFD. Accordingly, as the shift speed increases in MFD, the rotational speed will decrease. When the pinch plate makes contact with the veneer piece, the rotational speed of the tipple conveyor should be approximately equal to zero and the shift speed should be approximately equal to MFR.

Once the clip operation is completed and the clipper assembly has to return to its home position for another clip operation, the shift speed becomes negative as the assembly moves in the opposite direction as MFD, thus the rotational speed of in-feed and out-feed tipple conveyors 306 and 308 will be greater than MFR to counteract the negative shift speed. Accordingly, as the shift speed increases against MFD, the rotational speed will likewise increase.

Figure 6A:
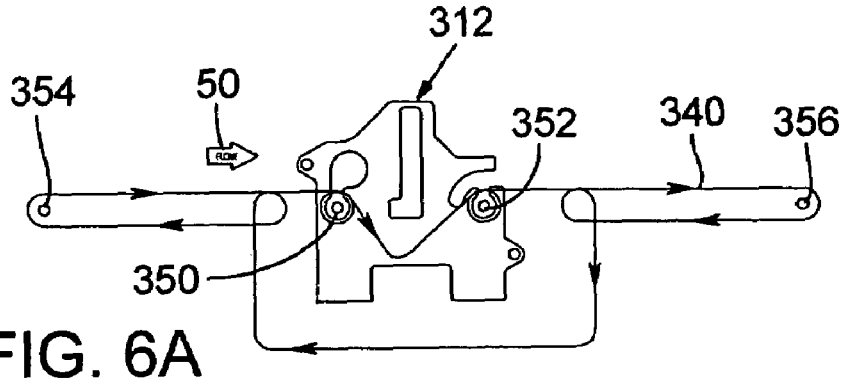
FIGS. 6A and 6B illustrate side views of a clipping station in accordance with various embodiments of the invention.
Figure 6B:
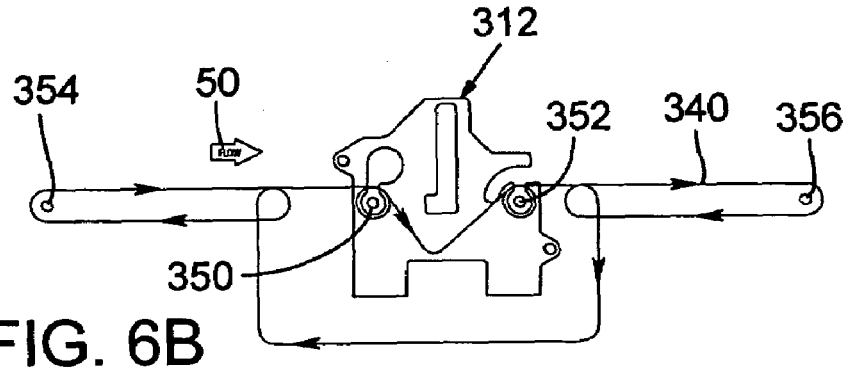

In one embodiment of the present invention, one or more drive belts may be used to control the rotational speed of the in-feed and out-feed conveyors as well as the in-feed and out-feed tipple conveyors. FIGS. 6A and 6B illustrate a belt drive configuration in accordance with an embodiment of the present invention. In one embodiment, a continuous drive belt 340 may be operationally coupled to the in-feed conveyor driver 354 and out-feed conveyor driver 356. Belt 340 may also be coupled to in-feed tipple conveyor driver 350 and out-feed tipple conveyor driver 352. In one embodiment, multiple belts may be used and adapted to operationally couple to the various drivers to control the rotational speed of the various conveyors.

Figure 7A:
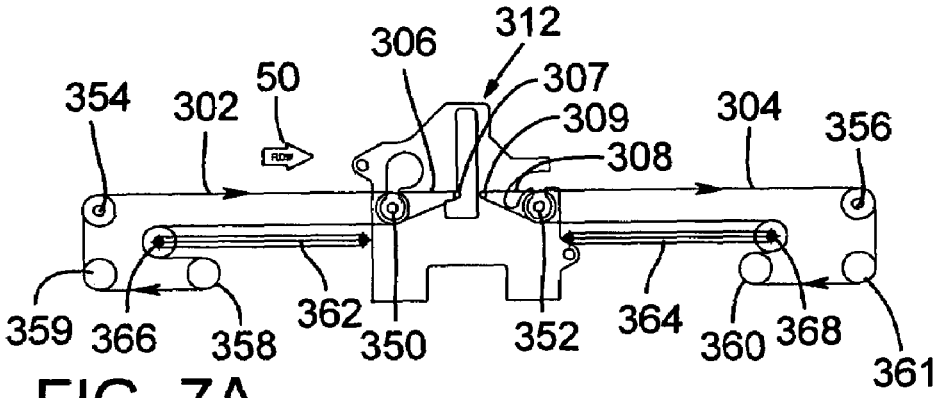
FIGS. 7A and 7B illustrate side views of clipping station in accordance with an embodiment of the invention.
Figure 7B:
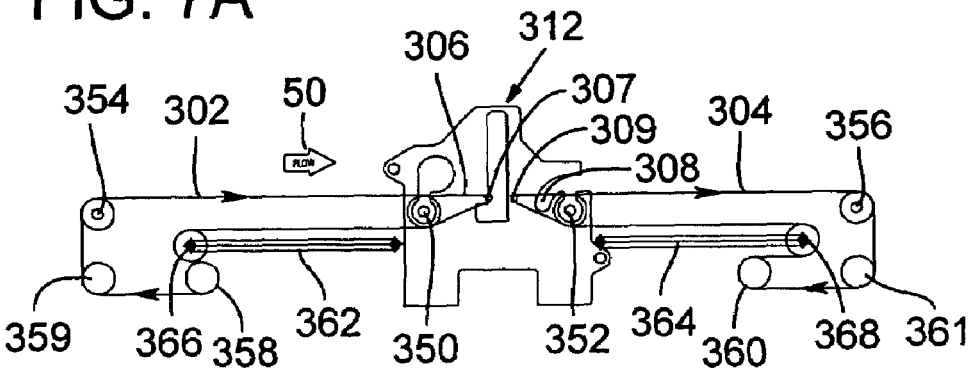

FIGS. 7A and 7B illustrate the in-feed and out-feed conveyor configuration of a clipping station in accordance with one embodiment of the present invention, where the rotational speed of the conveyors may be controlled in part by a belt drive as shown, for example, in FIGS. 6A and 6B. In one embodiment, in-feed conveyor 302 may have an end that overlaps with the in-feed tipple conveyor 306 on a common rotational axis at driver 350. Likewise, out-feed conveyor 304 may overlap with out-feed tipple conveyor 308 on a common rotational axis at driver 352.

In one embodiment, the tipple conveyors 306 and 308 may be coupled to carriage 313, such that as the carriage 313 shifts linearly with or against MFD, so do the tipple conveyors 306 and 308. Accordingly, in such an embodiment, both the tipple conveyor drivers 350 and 352 and the tipple conveyor idlers 307 and 309 may be coupled to the carriage 313, and thus adapted to shift linearly with carriage 313 and thus clipper assembly 310.

In one embodiment, the drive belt 340 may rotationally drive driver 354, thereby rotationally driving in-feed conveyor 302, and driver 356, and thus out-feed conveyor 304 at MFR. When the carriage 313 is stationary, e.g. prior to initiating a clip operation, drive belt 340 may rotationally drive the tipple conveyors 306 and 308 also at MFR. As the carriage 313 begins to move in MFD, the tipple conveyors 306 and 308 begin to shift linearly. By virtue of the engagement of the drive belt 340 with the tipple drivers 350 and 352, as the linear speed increases, the rotational speed of the tipple conveyors 306 and 308 may correspondingly decrease such that the sum of the rotational speed and the linear speed generally equal MFR, as seen by the veneer piece. Likewise, as the carriage 313 moves opposite MFD towards the home position, the passage of the drive belt 340 over the tipple drivers 350 and 352 will cause a rotational speed of the tipple belts to increase above MFR in order to maintain the rate seen by the veneer piece to be maintained substantially at MFR.

In one embodiment, where the in-feed conveyors and out-feed conveyors share a common rotational axis with the in-feed and out-feed tipple conveyors, the in-feed and out-feed conveyors may include a tensioning or slack absorption mechanism adapted to allow the overlapped end to move with the clipping assembly without causing the in-feed and out-feed conveyors' rotational speed to significantly deviate from MFR. FIGS. 7A and 7B illustrate an example of a belt slack absorption mechanism in accordance with an embodiment of the present invention.

In one embodiment, the slack absorption mechanism may include tension rods 362 and 364 that may be coupled to a corresponding roller 366 and 368. A further set of rollers 358 and 359 may work in conjunction with the tension rod 362 and roller 366 to take up or let out slack in in-feed conveyor 302 as carriage 313 moves linearly. Likewise, rollers 360 and 361 may work in conjunction with the tension rod 364 and roller 368 to take up or let out slack in out-feed conveyor 304 as carriage 313 moves linearly.

FIG. 7A illustrates an embodiment where the carriage 312 is in the home position, and the in-feed conveyor 302 is in a shortened condition while out-feed conveyor 304 is in its lengthened condition. As carriage 313 moves linearly in MFD, the slack absorption mechanism may take up the slack generated in the out-feed conveyor 304 as it goes from a lengthened condition to a shortened condition. Likewise, the slack tensioning mechanism may allow the in-feed conveyor 302 to go from its shortened condition to its lengthened condition. In other embodiments, other types of slack absorption and/or tensioning devices and configurations may be used.

In one embodiment of the present invention, the out-feed tipple conveyor 308 may be adapted to pivot about the axis of driver 352 in order to allow the clipped pieces to pass below the out-feed tipple conveyor and allow the clipped veneer sheet to be conveyed to the out-feed conveyor 304.

In one embodiment of the present invention, the drive belt 340 may be a toothed or splined belt having splines that are adapted to mesh with corresponding splines on the drivers 350, 352, 354, and 356. In other embodiments, the drive belt 340 may be a chain, non-splined belt or other band that may rotationally drive said drivers. In another embodiment, the conveyors may also be splined conveyors having splines adapted to mesh with corresponding splines on the drivers, or may be a non-splined belt. Yet in further embodiments, the rotational movement of in-feed and out-feed conveyors 302 and 304, and in-feed and out-feed tipple conveyors 306 and 308, may be independently controlled by servomotors or other speed controls.

Figure 8A:
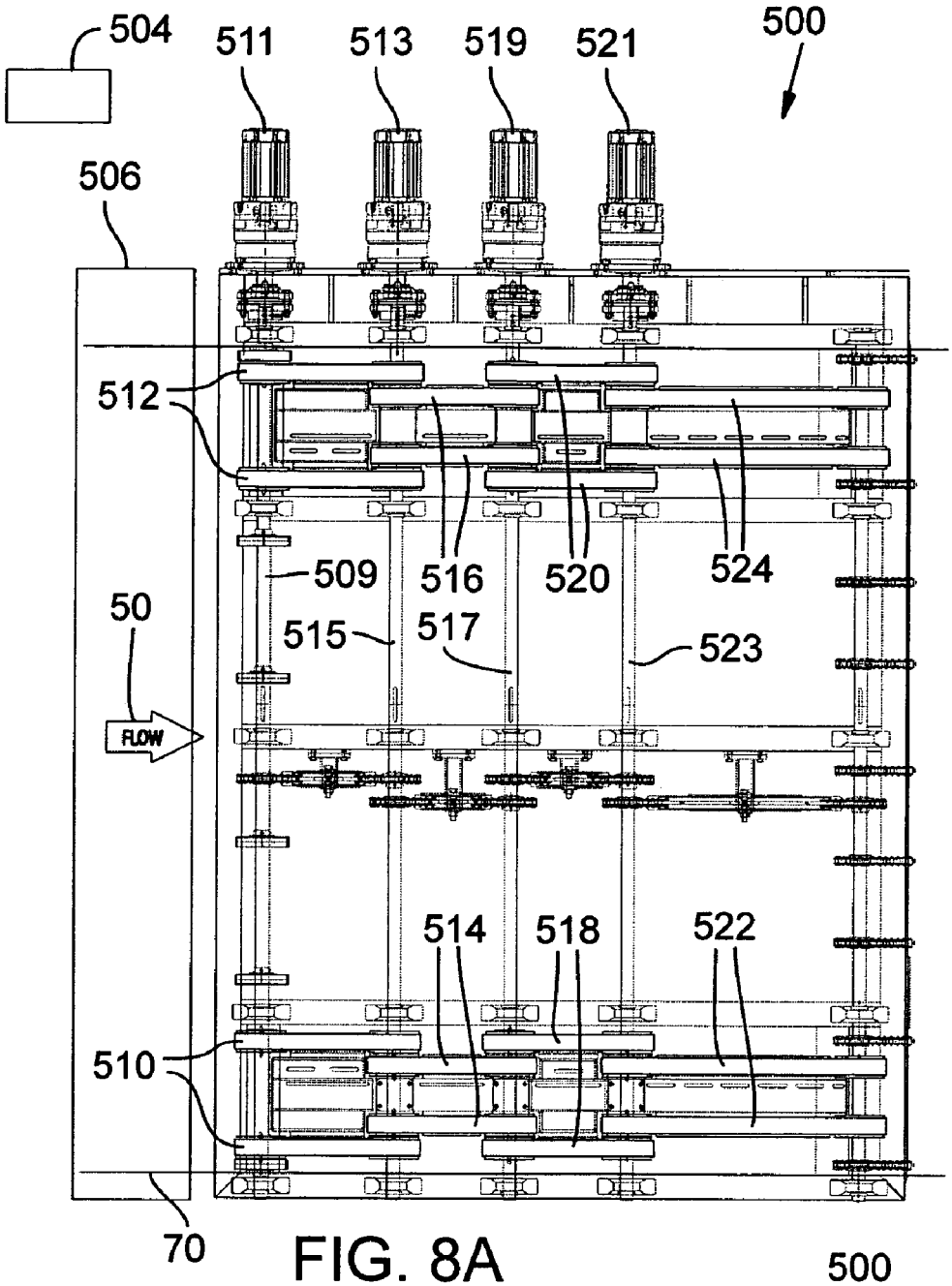
FIGS. 8A and 8B illustrate a top view and a side view respectively of a gap closing station in accordance with an embodiment of the present invention.
Figure 8B:
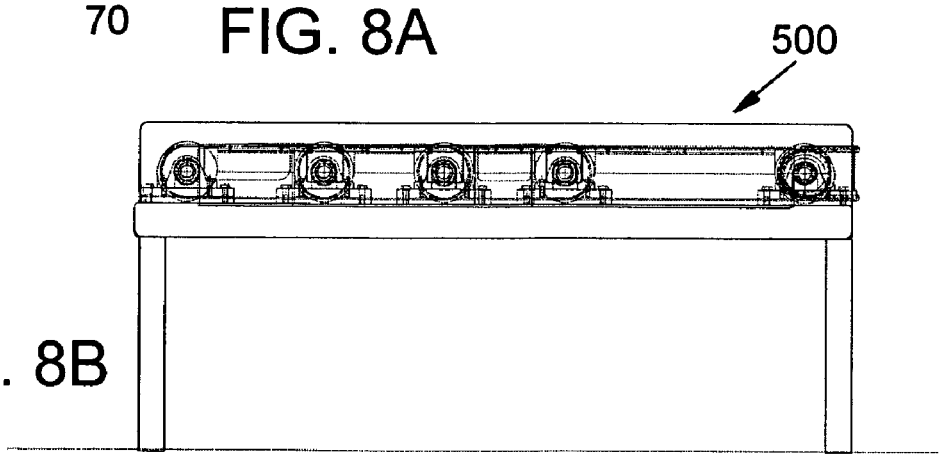

FIGS. 8A and 8B illustrate top and side views of a gap closing station in accordance with an embodiment of the present invention. Gap closing station 500 may include a plurality of paired staggered conveyors adapted to manipulate the speed of veneer pieces in order to close the gap between the trailing edge of a leading veneer piece and the leading edge of a trailing veneer piece without crowding the two pieces. In one embodiment, each conveyor pair has a corresponding conveyor pair located toward the opposite side of the gap closing station 500.

In one embodiment of the present invention, a first set of gap closing conveyors may be provided which include a first conveyor pair 510 disposed towards the reference side 70. A corresponding conveyor pair 512 may be disposed towards the opposite side of the gap closing station 500. First conveyor pairs 510 and 512 may be coupled together by a common drive shaft 509 and may be variably controlled by drivers 511, such as servomotors or other speed controls. A second conveyor pair 514 may be disposed towards the reference side 70 and staggered with respect to first conveyor pair 510. A corresponding second conveyor pair 516 may be disposed towards the opposite side of gap closing station 500 and staggers with respect to first conveyor pair 512, and which may be coupled together by a common drive shaft 515 and controlled by a driver 513. In one embodiment, second conveyor pairs 514 and 516 may have a leading end that share a common axis with a trailing end of first conveyor pairs 510 and 512 in order to facilitate transition of a veneer piece from first conveyor pairs 510 and 512 to second conveyor pairs 514 and 516.

While only two sets of opposing conveyors are necessary to complete the gap closing function in accordance with the present invention, the illustrated embodiment further includes a third conveyor pair 518 disposed towards the reference side 70 and a corresponding third conveyor pair 520 disposed towards the opposite side of gap closing station 500. Third conveyor pairs 518 and 520 may be coupled together by a drive shaft 517 and driven by driver 519. And, a fourth conveyor pair 522 disposed towards reference side 70 and a corresponding fourth conveyor pair 524 disposed towards the opposite side of gap closing station 500, and which share a common drive shaft 523 driven by driver 521.

In operation, a sensor 506 may determine the gap between the trailing edge of a leading veneer piece and the leading edge of a trailing veneer piece (Gap Data). In one embodiment, sensor 506 may include an encoder or other device adapted to determine the number of counts between adjacent edges of two veneer pieces. In one embodiment, sensor 506 may also be adapted to determine the width of the clipped veneer piece coming from the clipping station (Width Data). In another embodiment, Width Data may be retained from prior sensor data and a calculated width based on the executed Clip Solution.

Based on the Width Data, a controller 504 may position the leading veneer piece over a conveyor pair that is sufficient to accommodate the width of the veneer piece, or where the veneer piece width exceeds any one conveyor pair length, then the veneer piece will be positioned over multiple conveyor pairs. Based on the Gap Data between the leading veneer piece and the trailing veneer piece, controller 504 may control the drivers and thereby alter the rotational speed of the conveyors as needed in order to close the gap between such pieces. In one embodiment, the leading edge of the trailing piece may be brought into contact with the trailing edge of the leading piece without causing excessive impact or force between the two edges such that overlapping or bunching may be avoided.

Once said edges are brought together the two pieces are further conveyed through the gap closing station and another veneer piece may be brought together with the leading pieces in a similar fashion as described above. In one embodiment, more or less conveyor pairs may be used depending on the widths and gap sizes that may be encountered. In another embodiment, a variety of drivers may be used other than servomotors, including gear motors, belt drive motors and other speed controls. In one embodiment, the controller 504 may be a PLC, computer or other control mechanism. Yet in another embodiment, the controller may be integrated with the controller 204.

Once the gap is closed, the joined veneer pieces may be conveyed to a stringing station 540 or some other station adapted to secure the pieces in an edge-to-edge relationship for further processing.

Although specific embodiments have been illustrated and described herein for purposes of description of the preferred embodiment, it will be appreciated by those of ordinary skill in the art that a wide variety of alternate and/or equivalent implementations calculated to achieve the same purposes may be substituted for the specific embodiment shown and described without departing from the scope of the present invention. Those with skill in the art will readily appreciate that the present invention may be implemented in a very wide variety of embodiments. This application is intended to cover any adaptations or variations of the embodiments discussed herein. Therefore, it is manifestly intended that this invention be limited only by the claims and the equivalents thereof.

What is claimed is:

1. A veneer composer, comprising:

an inlet end where successive veneer pieces are received and an outlet end downstream of the inlet end, the composer having a first side and a second side and is adapted to move a veneer piece in a material flow direction from the inlet end to the outlet end between and generally parallel to the first side and the second side at a predetermined material flow rate;

a skew correct station having a first side conveyor and one or more de-skew conveyors, at least one of the one or more de-skew conveyors being disposed in at least a partially overlapping relationship to the first side conveyor and adapted to independently and controllably move at a rate that is less than, equal to, and greater than the rate of the first side conveyor to align a leading or trailing edge of the veneer piece substantially perpendicular with the material flow direction of the veneer piece;

a first clipper station positioned downstream of the skew correct station having a cutting blade disposed substantially perpendicular to the material flow direction and configured to clip a portion of the veneer piece that is necessary to square the leading edge or trailing edge and remove any defects in the veneer piece.

2. The veneer composer of claim 1, further comprising a first scanner positioned between the inlet end and the skew correct station to detect de-skew data on at least one edge of the veneer piece and a controller coupled to the first scanner and the skew correct station, the controller configured to receive the de-skew data and control the skew correct station to align the leading or trailing edge.

3. The veneer composer of claim 1, further comprising a second scanner positioned between the inlet end and the skew correct station and adapted to detect the alignment of the edges and any defects in the veneer piece that are not within a user specified defect parameter.

4. The veneer composer of claim 1, wherein each of said multiple de-skew conveyors share a common rotational axis to an adjacent de-skew conveyor.

5. The veneer composer of claim 1, wherein the first clipper station includes a clipper assembly adapted to shift linearly at a rate at least as fast as the material flow rate of the veneer piece, the clipper assembly adapted to carry a blade assembly, the clipper station also includes one or more in-feed and out-feed tipple conveyors.

6. The veneer composer of claim 5, wherein the first clipper station includes one or more in-feed conveyors adapted to convey the veneer piece to the one or more in-feed tipple conveyors and an out-feed conveyor adapted to receive the veneer piece from the one or more out-feed tipple conveyors.

7. The veneer composer of claim 5, wherein the sum of a given rotational speed and a shift speed of the in-feed and out-feed tipple conveyors is approximately equal to the material flow rate of the veneer piece.

8. A veneer composer, comprising:

an inlet end where successive veneer pieces are received and an outlet end downstream of the inlet end, the composer having a first side and a second side and is adapted to move veneer in a material flow direction from the inlet end to the outlet end between and generally parallel to the first side and the second side at a predetermined material flow rate;

a scanner disposed to scan veneer pieces placed in an inlet portion of the composer for defects, the scanner a skew correct station positioned downstream of the inlet end comprising a first side conveyor and a plurality of de-skew conveyors adapted to move at a rate that is faster, slower or the same as the rate of the first side conveyor to controllably square a first edge of a veneer with respect to the material flow direction;

a first clipper station configured to clip a portion of the veneer piece that is necessary to square a second edge and remove any defects in the veneer piece;

wherein the clipping station includes a clipper assembly adapted to shift linearly at a rate at least as fast as a material flow rate of the veneer piece, the clipper assembly adapted to carry a blade assembly and one or more in-feed and out-feed tipple conveyors; and wherein the sum of a given rotational speed and shift speed of the in-feed and out-feed tipple conveyors is approximately equal to the material flow rate of the veneer piece.

9. A veneer composer comprising:

an inlet end where successive veneer pieces are received and an outlet end downstream of the inlet end, the composer having a first side and a second side and is adapted to move veneer in a material flow direction from the inlet end to the outlet end between and generally parallel to the first side and the second side at a predetermined material flow rate;

a skew correct station down stream of the inlet end adapted to controllably align at least one of a leading edge and a trailing edge of a veneer piece to be substantially perpendicular with the material flow direction without a need to scan or register edges on the veneer piece that are between the leading edge and trailing edge; and a first clipper station downstream of the skew correct station having a blade for cutting the other of the leading edge and the trailing edge, the blade oriented substantially perpendicular to the material flow direction.

10. The veneer composer of claim 9, wherein the first clipper station includes a clipper assembly adapted to shift linearly at a rate at least as fast as the material flow rate, the clipper assembly adapted to carry a blade assembly and one or more in-feed and out-feed tipple conveyors.

11. The veneer composer of claim 10, wherein the sum of a given rotational speed and a shift speed of the in-feed and out-feed tipple conveyors is approximately equal to the material flow rate of the veneer piece.

12. The veneer composer of claim 9, further comprising a gap closing station downstream of the first clipper station configured to close a gap between the trailing edge of a leading veneer piece with the leading edge of a trailing veneer piece so the edges touch without excessive force.

13. The veneer composer of claim 12, wherein the gap closing station includes two first conveyors and two second conveyors, one of said two first conveyors and said two second conveyors being disposed towards the first side of the composer and the other of said two first conveyors and said two second conveyors being disposed towards the second side of the composer, wherein the one of said two first conveyors and one of said two second conveyors disposed towards the reference side each having an end that has a common rotational axis, and wherein the other one of said two first conveyors and the other one of said two second conveyors disposed towards the second side each having an end that has a common rotational axis.

14. A veneer composer for receiving veneer pieces peeled from logs having similar nominal lengths and random widths, and defining leading and trailing edges that extend along said lengths, said veneer composer comprising;

an inlet end whereat the veneer pieces are received, and an outlet end downstream from the inlet end, and a veneer piece positioning locator establishing an inlet feed position for the veneer pieces at said inlet end;

sensors positioned relative to the inlet end to obtain configuration data of the veneer piece relative to the locator and at least one controller receiving such data and determining from said data a desired position relative to said locator for the veneer piece including a desired clipping solution when in the desired position;

a skew correct station downstream of the sensors including a conveying and skewing mechanism responsive to the at least one controller, the mechanism including first and second side by side and spaced apart conveying members engaging a surface of the veneer piece to convey the veneer piece in the material flow direction, at least one of said conveying members responsive to the at least one controller to selectively convey one side of the veneer piece at a different speed then the other side to generate the desired position; and a clip station downstream of said skew station and responsive to the at least one controller for selectively clipping the leading and/or trailing edges of said veneer pieces as determined by said clipping solution.

15. A veneer composer as defined in claim 14, wherein the at least one of said conveying members has multiple segments for successive partial conveying of said veneer pieces and said multiple segments independently controlled by said controller to account for random widths of the veneer pieces.

16. A veneer composer as defined in claim 14, wherein the controller is programmed to determine a skew position and an edge clip solution that optimizes veneer piece utilization.

17. A veneer composer as defined in claim 14, wherein the controller is programmed to include industry standards of acceptability as applied to defects in the veneer piece and wherein the clip solution includes removal of defect portions as necessary to satisfy such industry standards.

18. A veneer composer as defined in claim 14, further comprising a gap closing station downstream of the clip station, the gap closing station including a speed controlled gap closing conveyor, the at least one controller to determine the relative positions as between a second veneer piece exiting the clip station and a preceding first veneer piece being conveyed from the clip station to the gap closing station, the at least one controller to dictate the speed of said gap closing conveyor to cause the respective leading and trailing edges of said second veneer piece and said preceding first veneer piece to close together in substantially edge abutting relation without undue bumping as between said edges of said veneer pieces.

19. A veneer composer as defined in claim 14, wherein the clip station comprises a veneer clipping assembly mounted to the composer at said clip station for motor driven back and forth movements of the assembly in the material flow direction, the clipping assembly including a blade having an up and down motor driven movement relative to the assembly such that the clipping blade cuts downwardly through the veneer and then upwardly retracted to a non-cutting position as dictated by the at least one controller.

20. The veneer composer of claim 1, further comprising a gap closing station configured to close a gap between the trailing edge of a leading veneer piece with the leading edge of a trailing veneer piece so the edges touch without excessive force.

21. The composer of claim 20, wherein the gap closing station includes two first conveyors and two second conveyors, one of said two first conveyors and one of said two second conveyors being disposed towards the first side of the composer and the other of said two first conveyors and other of said two second conveyors being disposed towards an opposite side of the composer, said first conveyor and said second conveyors disposed towards the first side each having an end that has a common rotational axis, and said other of said first conveyors and other of said second conveyors disposed towards the opposite side, each having an end that has a common rotational axis.

* * * * *